US009238568B2

(12) United States Patent
Nonami

(10) Patent No.: US 9,238,568 B2
(45) Date of Patent: Jan. 19, 2016

(54) HALL CALL REGISTRATION APPARATUS OF ELEVATOR INCLUDING A DESTINATION FLOOR CHANGING DEVICE

(75) Inventor: Yoshinori Nonami, Aichi (JP)

(73) Assignee: Mitsubishi Electric Corporation, Tokyo (JP)

( * ) Notice: Subject to any disclaimer, the term of this patent is extended or adjusted under 35 U.S.C. 154(b) by 587 days.

(21) Appl. No.: 13/698,683

(22) PCT Filed: Jul. 14, 2010

(86) PCT No.: PCT/JP2010/061873
§ 371 (c)(1),
(2), (4) Date: Nov. 19, 2012

(87) PCT Pub. No.: WO2012/008024
PCT Pub. Date: Jan. 19, 2012

(65) Prior Publication Data

US 2013/0068568 A1 Mar. 21, 2013

(51) Int. Cl.
*B66B 1/20* (2006.01)
*B66B 1/46* (2006.01)

(52) U.S. Cl.
CPC ..... *B66B 1/468* (2013.01); *B66B 2201/4615* (2013.01); *B66B 2201/4638* (2013.01)

(58) Field of Classification Search
CPC ..... B66B 1/468; B66B 2201/4615; B66B 2201/4638
USPC ..... 187/247, 380–388, 391–393, 396
See application file for complete search history.

(56) References Cited

U.S. PATENT DOCUMENTS 5,689,094 A 11/1997 Friedli et al.
6,707,374 B1 * 3/2004 Zaharia ..... 340/5.31

(Continued)

FOREIGN PATENT DOCUMENTS

JP 8 81143 3/1996
JP 11 349238 12/1999

(Continued)

OTHER PUBLICATIONS

International Search Report Issued Mar. 29, 2011 in PCT/ JP10/ 61873 Filed Jul. 14, 2010.

(Continued)

*Primary Examiner* — Anthony Salata
(74) *Attorney, Agent, or Firm* — Oblon, McClelland, Maier & Neustadt, L.L.P.

(57) ABSTRACT

An elevator hall call registration apparatus automatically registers a destination floor call based on verification information by a personal authentication device. The hall call registration apparatus includes a first personal authentication device which authenticates a user, a hall call registration apparatus main body which performs destination floor call registration based on verification information including personal ID unique to the user verified in the first personal authentication device, and a destination floor changing device which accepts an operation for the user to perform at least one of a change and cancel of the destination floor of a destination floor call registration. If it is judged based on an operation performed in the destination floor changing device that the operation is performed by the user authenticated by the first personal authentication device, the hall call registration apparatus can perform a change and cancel of a destination floor of the destination floor call registration.

3 Claims, 6 Drawing Sheets

(56) References Cited

U.S. PATENT DOCUMENTS

| | | | | |
|---|---|---|---|---|
| 7,328,775 | B2 * | 2/2008 | Zaharia et al. | 187/396 |
| 7,353,915 | B2 * | 4/2008 | Zaharia et al. | 187/388 |
| 7,500,544 | B2 * | 3/2009 | Hakala et al. | 187/382 |
| 7,581,622 | B2 * | 9/2009 | Amano | 187/384 |
| 7,849,974 | B2 * | 12/2010 | Stanley et al. | 187/387 |
| 8,061,485 | B2 * | 11/2011 | Finschi | 187/384 |
| 8,490,754 | B2 * | 7/2013 | Amano | 187/384 |
| 8,813,917 | B2 * | 8/2014 | Salmikuukka et al. | 187/384 |
| 8,857,569 | B2 * | 10/2014 | Friedli | 187/384 |
| 8,910,752 | B2 * | 12/2014 | Furutani | 187/384 |
| 2009/0020372 | A1 | 1/2009 | Amano | |
| 2011/0127117 | A1 | 6/2011 | Amano | |
| 2012/0145488 | A1 * | 6/2012 | Nakashima | 187/389 |

FOREIGN PATENT DOCUMENTS

| | | | |
|---|---|---|---|
| JP | 2003 312947 | | 11/2003 |
| JP | 2003-341945 | A | 12/2003 |
| JP | 2004 75361 | | 3/2004 |
| JP | 2011-241061 | A | 12/2011 |
| WO | 2006 043324 | | 4/2006 |
| WO | WO 2009/116129 | A1 | 9/2009 |
| WO | 2010 023723 | | 3/2010 |

OTHER PUBLICATIONS

Office Action issued on Dec. 11, 2013 in the corresponding Korean Patent Application No. 10-2013-7000769 (with partial English Translation).

Japanese Office Action issued Feb. 4, 2014 in Patent Application No. 2012-524366 with Partial English Translation.

English translation of the International Preliminary Report on Patentability issued Feb. 21, 2013 in PCT/JP2010/061873.

English translation of the Written Opinion of the International Searching Authority issued Mar. 29, 2011 in PCT/JP2010/061873.

Korean Office Action issued May 20, 2014, in Korea Patent Application No. 10-2013-7000769 (with English translation).

* cited by examiner fig. 2

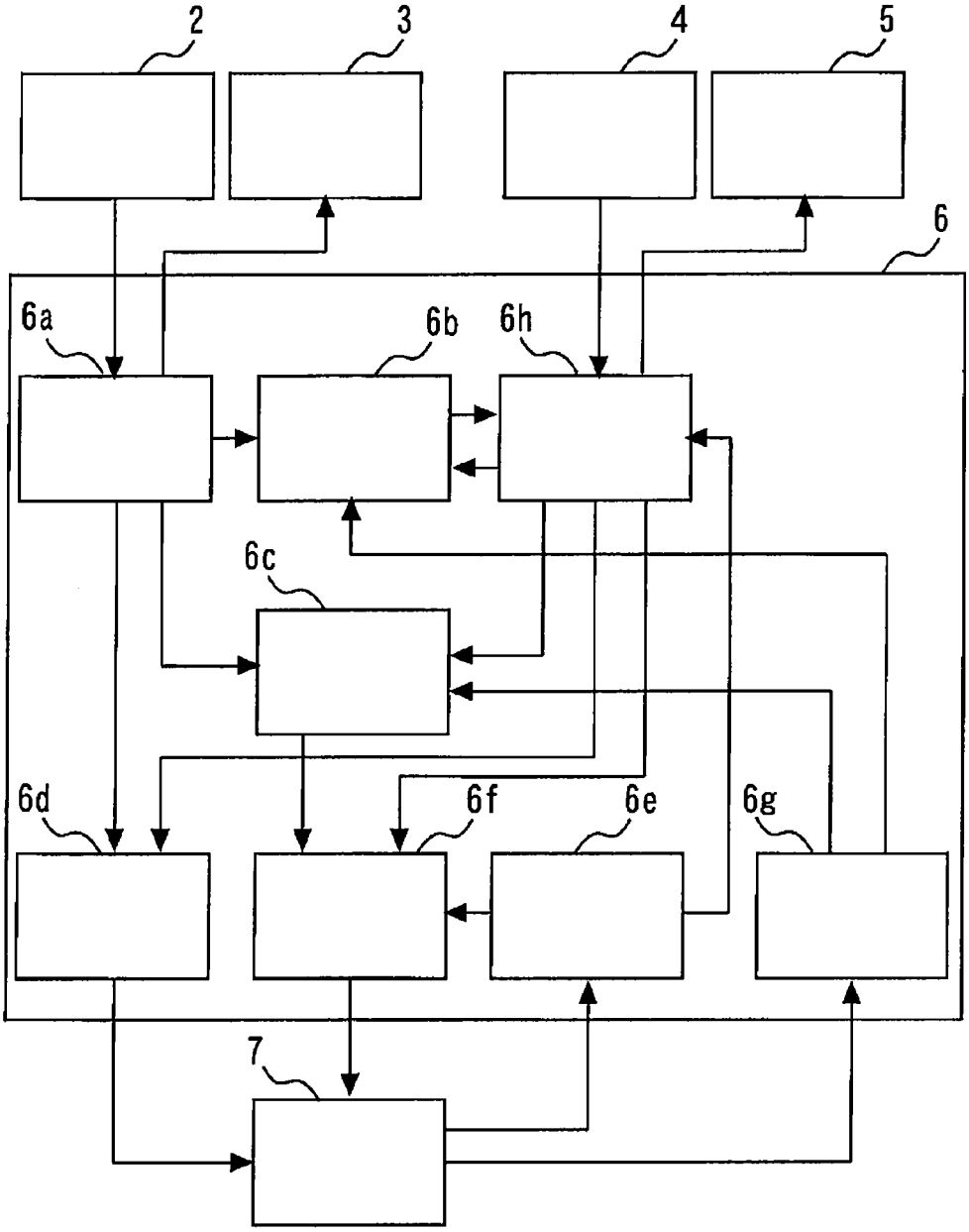

2: DESTINATION FLOOR REGISTRATION APPARATUS
3: REGISTERED, ASSIGNED ELEVATOR INDICATOR
4: DESTINATION FLOOR CHANGING DEVICE
5: CHANGED, ASSIGNED ELEVATOR INDICATOR
6: HALL CALL REGISTRATION APPARATUS MAIN BODY
6a: DESTINATION FLOOR REGISTRATION SECTION
6b: DESTINATION FLOOR REGISTRAR STORAGE SECTION
6c: REGISTERED DESTINATION FLOOR STORAGE SECTION
6d: CAR ARRANGEMENT SECTION 6e: CAR ARRIVAL DETECTION SECTION
6f: CAR CALL REGISTRATION/DELETION SECTION
6g: CAR DEPARTURE DETECTION SECTION
6h: DESTINATION FLOOR CHANGING SECTION
7: EACH-ELEVATOR CONTROLLER fig. 3

| PERSONAL ID | DESTINATION FLOOR | ASSIGNED ELEVATOR |
|---|---|---|
| 001 | 3 | A |
| 002 | 7 | A |
| 003 | 3 | A |
| 004 | 5 | B |
| 005 | 8 | B |
| 006 | 6 | C |
| 007 | 3 | A |
| 008 | 5 | B |
| 009 | 9 | A |
| 010 | 3 | A |

HALL CALL REGISTRATION APPARATUS OF ELEVATOR INCLUDING A DESTINATION FLOOR CHANGING DEVICE

TECHNICAL FIELD

The present invention relates to a hall call registration apparatus of an elevator.

BACKGROUND ART

In recent years, there have been an increasing number of cases where a security gate is installed in the entrance and the like of a building. This security gate is intended for authenticating a person who is going to pass through the gate. And when the person is authenticated at the security gate, the security gate is opened to permit the person to pass through the gate. And in the case where an elevator is installed in a building where such a security gate is installed, usually, no person can move to an elevator hall in the building unless a person passes through this gate by succeeding in the authentication at the security gate.

As one of conventional hall call registration apparatuses of an elevator installed in a building having such a security gate, there is known a hall call registration apparatus of an elevator which opens a security gate installed on the entrance floor of a building and automatically registers an elevator hall call to the entrance floor when a person is authenticated at the security gate (refer to Patent Literature 1, for example).

In group controller elevators which control a plurality of elevators as a group (a bank) installed in a building having a security gate, there is known a hall call registration apparatus of an elevator which identifies a destination floor of a person who was verified from verification information at the security gate and assigns a car for each identified destination floor (refer to Patent Literature 2, for example). In the hall call registration apparatus of an elevator described in Patent Literature 2, a destination floor is indicated in the hall for each assigned car. And when it is detected that a passenger has boarded a car, in this car, a destination floor call in which the identified destination floor is a desired destination floor, is automatically registered.

Incidentally, in an elevator installed in an apartment house sharing an entrance, there is also known a hall call registration apparatus of an elevator which automatically registers a hall call to a floor when it is detected that a resident of this floor other than the entrance floor has left his or her house (refer to Patent Literature 3, for example). In the hall call registration apparatus of an elevator described in Patent Literature 3, after the arrival of a car at the floor on which the resident left his or her house, a destination floor call is automatically registered in order to cause this car to run to the entrance floor.

CITATION LIST

Patent Literature

Patent Literature 1: Japanese Patent Laid-Open No. 2004-075361

Patent Literature 2: International Publication No. WO2006-043324

Patent Literature 3: Japanese Patent Laid-Open No. 11-349238

SUMMARY OF INVENTION

Technical Problem

As described above, in the conventional hall call registration apparatuses of an elevator described in the Patent Literatures described above, when verification is performed at a security gate, a hall call for calling a car to the floor on which this gate is installed is automatically registered. And when the car arrives at the floor on which the gate is installed, on the basis of verification information at the gate, a destination floor call is automatically registered for this car.

For this reason, in the conventional hall call registration apparatuses of an elevator as described above, when a user goes to a floor other than the destination floor registered beforehand in the verification information of the gate, it is necessary that a call to a desired destination floor be newly registered, which is troublesome. In addition, this case also poses the problem that the destination floor call registration performed automatically on the basis of the verification information of the gate becomes useless. And there is also the problem that the operational efficiency of the elevator becomes worse due to the useless destination floor call registration The present invention has been made in order to solve such problems and provides a hall call registration apparatus of an elevator which eliminates useless destination floor call registration and prevents the worsening of the operational efficiency in the case where in a hall call registration apparatus which automatically registers a destination floor call on the basis of verification information by a personal authentication device, such as a security gate, a user desires to go to a destination floor different from a destination floor of a call registration which is automatically performed.

Means for Solving the Problems

A hall call registration apparatus of an elevator according to the present invention, comprises: a first personal authentication device which authenticates a user of an elevator; a hall call registration apparatus main body which performs destination floor call registration of an elevator on the basis of verification information including personal ID unique to the user who was verified by the first personal authentication device; and a destination floor changing device which accepts an operation for the user to perform at least one of a change and a cancel of the destination floor call registration, wherein in the case where it is judged on the basis of the contents of an operation performed in the destination floor changing device that the operation is performed by the user who is authenticated by the first personal authentication device, the hall call registration apparatus main body performs a change and/or a cancel of the destination floor of the destination floor call registration.

Advantageous Effects of Invention

The hall call registration apparatus of an elevator according to the present invention produces the effects that useless destination floor call registration is eliminated and the worsening of the operational efficiency is prevented beforehand in a hall call registration apparatus of an elevator which automatically registers a destination floor call on the basis of verification information by a personal authentication device, such as a security gate, in the case where a user desires to go to a destination floor different from a destination floor of call registration which is automatically performed.

BRIEF DESCRIPTION OF THE DRAWINGS

FIG. 2 is a block diagram showing the general configuration of the hall call registration apparatus of an elevator related to Embodiment 1 of the present invention.

FIG. 3 is a diagram showing an example of contents of the information table stored in destination floor registrar storage section related to Embodiment 1 of the present invention.

DESCRIPTION OF EMBODIMENTS

The present invention will be described with reference to the accompanying drawings. Incidentally, in each of the drawings, like numerals refer to like parts or corresponding parts and overlaps of description of these parts are appropriately simplified or omitted.

Embodiment 1

Figure 1:
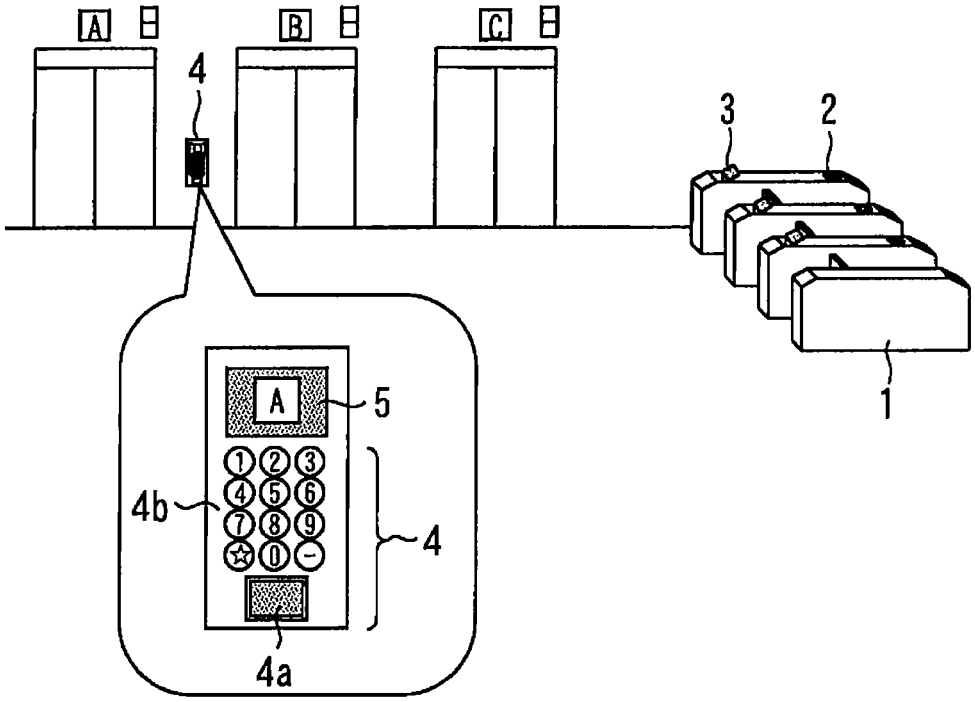
FIG. 1 is a diagram showing an elevator hall and a security gate related to Embodiment 1 of the present invention.

FIGS. 1 to 4 relate to Embodiment 1 of the present invention. FIG. 1 shows an elevator hall and a security gate. In FIG. 1, reference numeral 1 denotes a security gate installed in a place leading to an elevator hall. This security gate 1 is closed in normal times. A user who desires to go to the elevator hall after passing through the security gate 1 performs personal authentication at the security gate 1. And in the case where it is authenticated in this personal authentication that the user is the person who was permitted to walk through, the security gate 1 opens and the user can walk through the security gate 1.

As methods of personal authentication at this security gate 1, it is possible to use various kinds of authentication methods, such as biometric authentication using the fingerprints, irises and the like of a user, authentication using RFID (radio frequency identification), and authentication using the personal identification number and password through an input using numerical keys.

The case where RFID is used will be described here. A user carries an ID card in which an RFID tag is buried. The personal ID unique to each user and the destination floor of the user who carries this ID card are stored in this ID card beforehand. The user who is going to pass through the security gate 1 causes the information stored in the ID card carried by the user himself or herself to be read by holding the Id card over the personal authentication device provided at the security gate 1.

The personal authentication device of the security gate 1 ascertains whether or not the personal ID read from the ID card is the ID for which the passage was permitted. In the case where it is ascertained that this read personal ID is the ID for which the passage was permitted, the security gate 1 is opened. On the other hand, in the case where it is not ascertained that this read personal ID is the ID for which the passage was permitted, the security gate is kept in a closed condition and the user cannot pass through the security gate 1.

The security gate 1 is provided with a destination floor registration apparatus 2 and a registered, assigned elevator indicator 3.

The destination floor registration apparatus 2 is intended for transmitting the information on the personal ID read from the ID card carried by the user in the above personal authentication and on the destination floor to a hall call registration apparatus main body 6 (described in FIG. 2). As will be described later, in the hall call registration apparatus main body 6, destination floor call registration is performed on the basis of the information on the personal ID and destination floor transmitted from this destination floor registration apparatus 2.

The registered, assigned elevator indicator 3 is intended for indicating the assigned car information transmitted from the hall call registration apparatus main body 6 to a user who passes through the security gate 1. The assigned car information indicated here is the information on the elevator of the assigned car determined in the hall call registration apparatus main body 6 on the basis of the personal ID and destination floor transmitted from this destination floor registration apparatus 2.

The entrance of each elevator is provided in the elevator hall to which the security gate 1 leads. The elevator name assigned to each elevator is indicated above these entrances. Here, these elevator names are "A," "B," and "C." And the destination floor changing device 4 and a changed, assigned elevator indicator 5 are installed, for example, on the wall surface of the hall.

The destination floor changing device 4 is intended for changing the destination floor of the destination floor call registration which was performed via the destination floor registration apparatus 2. The destination floor changing device 4 has a personal authentication device 4*a* and a destination floor input device 4*b*. The personal authentication device 4*a* is intended for reading the personal ID of an ID card carried by a user. The destination floor input device 4*b* is intended for inputting the destination floor to which a user desires to go as the destination floor after the change. This destination floor input device 4*b* comprises numerical keys having numerical buttons of 0 to 9, for example.

A user who desires to change the destination floor to a floor different from the floor stored beforehand in the ID card, causes the personal ID stored in the ID card to be read, for example, by holding his or her ID card over the personal authentication device 4*a* of the destination floor changing device 4 in the hall. Next, the user inputs the desired destination floor using the destination floor input device 4*b*. Then, the destination floor changing device 4 transmits, to the hall call registration apparatus main body 6, the personal ID read by the personal authentication device 4*a* and the information on the destination floor after the change inputted via the destination floor input device 4*b*.

The changed, assigned elevator indicator 5 is installed in the vicinity of the destination floor changing device 4. This changed, assigned elevator indicator 5 is intended for indicating the changed, assigned car information transmitted from the hall call registration apparatus main body 6 to a user who passes through the security gate 1. The changed, assigned car information indicated here is the information on the elevator of an assigned car determined in the hall call registration apparatus main body 6 on the basis of the personal ID and destination floor after the change transmitted from the destination floor changing device 4.

FIG. 2 shows the general configuration of the hall call registration apparatus of an elevator. As shown in this figure, the hall call registration apparatus main body 6 is provided with a destination floor registration section 6*a*, a destination floor registrar storage section 6*b*, a registered destination floor storage section 6*c*, a car arrangement section 6*d*, a car arrival detection section 6*e*, a car call registration/deletion section 6*f*, a car departure detection section 6*g*, and a destination floor changing section 6*h*.

The operation of each of the elevators (here, three elevators of Elevator A, Elevator B, and Elevator C) is controlled by an each-elevator controller 7.

On the basis of the personal ID and destination floor transmitted from the above-described destination floor registration apparatus 2, the destination floor registration section 6*a* determines a car to be assigned to the destination floor of the user who has this ID. And the destination floor registration section 6*a* outputs the information on the destination floor and assigned car information to the destination floor registrar storage section 6*b*. Also, the destination floor registration section 6*a* outputs the information on the destination floor and assigned car information to the registered destination floor storage section 6*c*. Furthermore, the destination floor registration section 6*a* outputs assigned car information to the registered, assigned elevator indicator 3 and the car arrangement section 6*d*.

On the basis of the information outputted from the destination floor registration section 6*a*, the destination floor registrar storage section 6*b* stores a destination floor and an assigned elevator of the car to this destination floor by correlating the destination floor and the assigned elevator of the car to each personal ID. An example of the information table stored in this destination floor registrar storage section 6*b* is shown in FIG. 3. In FIG. 3, the destination floor for personal ID 001 is the 3rd floor and the car of Elevator A is assigned to this destination floor. And the destination floor for personal ID 002 is the 7th floor and the car of Elevator A is assigned to this destination floor. The same applies also to personal ID 003 to 010.

On the basis of the information on the destination floor and assigned car information outputted from the destination floor registration section 6*a*, the registered destination floor storage section 6*c* stores the destination floors of calls registered for the car of each elevator.

On the basis of the assigned car information outputted from the destination floor registration section 6*a*, the car arrangement section 6*d* transmits, to the each-elevator controller 7 which controls the relevant assigned car, a car arrangement instruction to cause the relevant assigned car to run to a call-occurring floor. Here, a call-occurring floor refers to a floor which provides the source of occurrence of a call for causing the car to run to the destination floor, and is a departure floor to the destination floor. Therefore, in this case, a call-occurring floor means the floor on which there is a hall leading from the security gate 1. That is, that the car arrangement section 6*d* transmits a car arrangement instruction to an each-elevator controller 7 which controls the relevant assigned car so that the relevant assigned car is caused to run to a call-occurring floor, is the same as registering a hall call to a call-occurring floor.

On the basis of the information on the operational condition of the car of each elevator outputted from an each-elevator controller 7, the car arrival detection section 6*e* detects that the car of each elevator arrived at a call-occurring floor. And in the case where an elevator which arrived at the call-occurring floor is detected, the car arrival detection section 6*e* outputs the information on the elevator which arrived at the call-occurring floor to the car call registration/deletion section 6*f* and the destination floor changing section 6*h*.

On the basis of the information on the elevator which arrived at the call-occurring floor outputted from the car arrival detection section 6*e*, the car call registration/deletion section 6*f* obtains, from the registered destination floor storage section 6*c*, the destination floor of the relevant elevator which arrived at the call-occurring floor. And the car call registration/deletion section 6*f* outputs, to the each-elevator controller 7 which controls the relevant elevator, an instruction to perform the registration of the destination floor call to the obtained destination floor.

On the basis of the information on the operational condition of the car of each elevator outputted from an each-elevator controller 7, the car departure detection section 6*g* detects that after the arrival of the car of each elevator at a call-occurring floor, the car of each elevator departed from this call-occurring floor. And in the case where the car departure detection section 6*g* detected the departure of an elevator from the call-occurring floor, the car departure detection section 6*g* outputs the information on the elevator which departed from the call-occurring floor to the destination floor registrar storage section 6*b* and the registered destination floor storage section 6*c*.

On the basis of the information on the elevator which departed from the call-occurring floor outputted from the car departure detection section 6*g*, the destination floor registrar storage section 6*b* and the registered destination floor storage section 6*c* update the contents stored in both. Specifically, the destination floor registrar storage section 6*b* deletes the data on the personal ID to which the relevant elevator which departed from the call-occurring floor is assigned. And the registered destination floor storage section 6*c* deletes the data on the destination floor for the relevant elevator.

On the basis of the personal ID transmitted from the above-described destination floor changing device 4 as well as the destination floor after the change and the personal ID and destination floor obtained from the destination floor registrar storage section 6*b*, the destination floor changing section 6*h* performs the change of the destination floor of the user who has this personal ID. That is, on the basis of these pieces of information, the destination floor changing section 6*h* changes the destination floor for the relevant personal ID, and determines a newly assigned car for the destination floor after this change. And the destination floor changing section 6*h* outputs the personal ID, the information on the destination floor after the change, and assigned car information after the change to the destination floor registrar storage section 6*b*. Also, the destination floor changing section 6*h* outputs the information on the destination floor after the change and the assigned car information after the change to the registered destination floor storage section 6*c*. Furthermore, the destination floor changing section 6*h* outputs the assigned car information after the change to the changed, assigned elevator indicator 5 and the car arrangement section 6*d*. In addition, the destination floor changing section 6*h* outputs the information on the destination floor before the change and the assigned car information before the change to the car call registration/deletion section 6*f*.

On the basis of the information after the change outputted from the destination floor registration section 6*a*, the destination floor registrar storage section 6*b* and the registered destination floor storage section 6*c* update the contents stored in both. Specifically, the destination floor registrar storage section 6*b* stores the destination floor after the change and the assigned elevator of the car after the change for the relevant destination floor. And the registered destination floor storage section 6*c* stores the destination floor after the change for the relevant elevator after the change.

On the basis of the information on the assigned car after the change outputted from the destination floor changing section 6*h*, the car arrangement section 6*d* transmits, to the each-elevator controller 7 which controls the relevant assigned car after the change, a car arrangement instruction to cause the relevant assigned car after the change to run to the call-occurring floor. And on the basis of the information on the destination floor before the change and the assigned car information before the change, which were outputted from the destination floor changing section 6*h*, the car call registration/deletion section 6*f* outputs, to the each-elevator controller 7 which controls the assigned car (elevator) before the change, an instruction to delete the destination floor call registration to the destination floor before the change.

An each-elevator controller 7 controls the operation of each elevator in accordance with the car arrangement instruction and call registration which were performed as described above.

Figure 4:
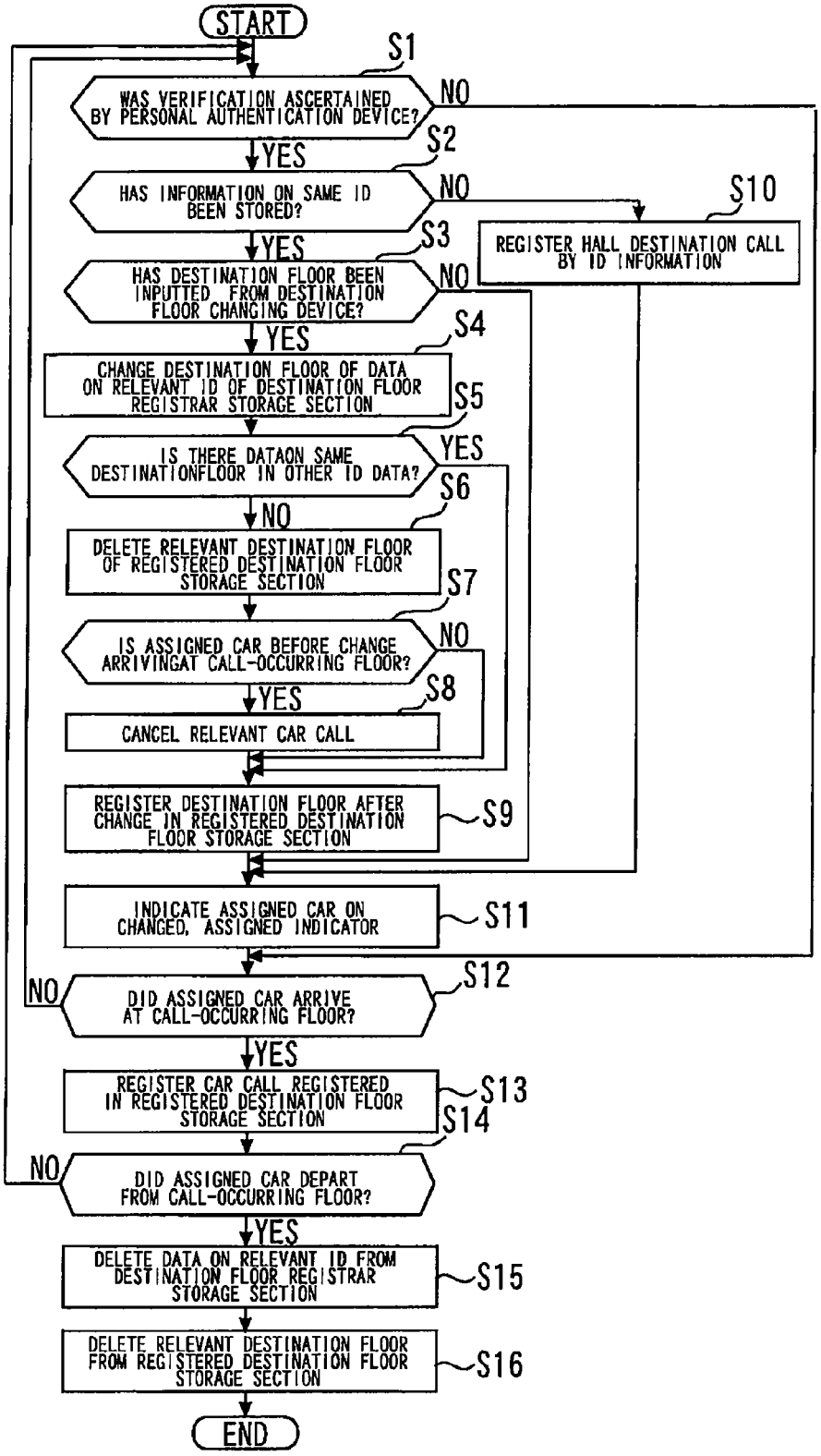
FIG. 4 is a flowchart showing the flow of operations of the hall call registration apparatus of an elevator related to Embodiment 1 of the present invention.

In this embodiment, the hall call registration apparatus of an elevator acts in accordance with a series of flow of actions shown in FIG. 4.

First, in Step S1, the hall call registration apparatus main body 6 ascertains whether or not verification was performed by a user by use of an ID card via the personal authentication device 4*a* of the destination floor changing device 4 (or the personal authentication device of the destination floor registration apparatus 2). In the case where in Step S1 it is ascertained that the verification was performed by the personal authentication device, the flow of actions proceeds to Step S2. On the other hand, in the case where it is ascertained that the verification was not performed, the flow of actions proceeds to Step 12.

In Step S2 by referring to the information table of the destination floor registrar storage section 6*b*, the hall call registration apparatus main body 6 ascertains whether or not the destination floor and the assigned elevator have already been stored for the same personal ID as the personal ID transmitted from the personal authentication device. In the case where in Step S2 it is ascertained that the destination floor and the assigned elevator have already been stored for the same personal ID as the personal ID from the personal authentication device, the flow of actions proceeds to Step S3. On the other hand, in the case where it is ascertained that the destination floor and the assigned elevator have not been stored for the same personal ID, the flow of actions proceeds to Step S10.

Also in Step S3 the hall call registration apparatus main body 6 ascertains whether or not a destination floor which a user desires to change has been inputted via the destination floor input device 4*b* of the destination floor changing device 4. In the case where in Step S3 it is ascertained that the destination floor has been inputted to the destination floor input device 4*b*, the flow of actions proceeds to Step S4. On the other hand, in the case where it is ascertained that the destination floor has not been inputted, the flow of actions proceeds to Step S11.

In Step S4, the hall call registration apparatus main body 6 updates the contents of the information table stored in the destination floor registrar storage section 6*b*. That is, concerning the information table stored in the destination floor registrar storage section 6*b*, the hall call registration apparatus main body 6 changes the destination floor for the personal ID ascertained in Step S2 to the destination floor which was inputted via the destination floor input device 4*b*, which was ascertained in Step S3. Also, the hall call registration apparatus main body 6 changes the assigned elevator for the relevant personal ID to the assigned elevator of the car after the change, which was determined in the destination floor changing section 6*h*.

Step S4 is followed by Step S5. In Step S5 the hall call registration apparatus main body 6 ascertains the contents of the information table stored in the destination floor registrar storage section 6*b*. And concerning the destination floors and assigned elevators for other personal IDs except the personal ID whose storage contents were changed in Step S4 described above, the hall call registration apparatus main body 6 ascertains whether or not there is other personal ID data which is the same as the destination floor and the assigned elevator before the change for the personal ID whose storage contents were changed. In the case where in Step S5 it is ascertained that there is no other personal ID data which is the same as both the destination floor and the assigned elevator before the change for the personal ID whose storage contents were changed, the flow of actions proceeds to Step S6. On the other hand in the case where it is ascertained that there is other personal ID data which is the same as both the destination floor and the assigned elevator before the change for the personal ID whose storage contents were changed, the flow of actions proceeds to Step S9.

In Step S6 it was ascertained that there is no other personal ID data in which both the destination floor and the assigned elevator before the change for the personal ID whose memory contents had been changed in Step S5 described above are the same. Therefore, the hall call registration apparatus main body 6 deletes the data on the relevant destination floor and assigned elevator before the change stored in the registered destination floor storage section 6*c*. That is, the registered destination floor storage section 6*c* of the hall call registration apparatus main body 6 deletes the destination floor before the change for the relevant assigned elevator before the change.

Step S6 is followed by Step S7. In Step S7 on the basis of the outputs from the car arrival detection section 6*e* and the car departure detection section 6*g*, the hall call registration apparatus main body 6 ascertains whether or not the car of the assigned elevator before the change is arriving at the call-occurring floor. In the case where in Step S7 it is ascertained that the assigned car before the change is arriving at the call-occurring floor, the flow of actions proceeds to Step S8. On the other hand, in the case where it is not ascertained that the assigned car before the change is not arriving at the call-occurring floor, the flow of actions proceeds to S9 by skipping over Step S8.

In Step S8 the car call registration/deletion section 6*f* of the hall call registration apparatus main body 6 cancels (deletes) the same car call registration as the car call deleted from the storage contents of the registered destination floor storage section 6*c* in Step S6 described above. That is, the car call registration/deletion section 6*f* deletes the car call registration to the destination floor before the change for the assigned elevator before the change.

After Step S8, in the case where in Step S7 it is ascertained that the assigned car before the change is not arriving at the call-occurring floor, and in the case where in Step S5 it is ascertained that there is other personal ID data which is the same as both the destination floor and the assigned elevator before the change for the personal ID whose storage contents were changed, the flow of actions proceeds to Step S9. In Step S9 the hall call registration apparatus main body 6 updates the storage contents of the registered destination floor storage section 6*c* to the storage contents after the change. That is, concerning the storage contents of the registered destination floor storage section 6*c*, the hall call registration apparatus main body 6 newly registers the destination floor after the change inputted via the destination floor input device 4*b* as a destination floor for the elevator of the assigned car after the change determined in the destination floor changing section 6*h*.

Concerning the actions described above, a specific example will be described by referring to FIG. 3. For example, it is assumed that a user having personal ID 003 changes his or her destination floor from the 3rd floor to another floor. In this case, in the registered destination floor storage section 6*c*, the registration of the destination floor after the change is performed, but the deletion of the destination floor before the change is not performed. This is because the destination floor for the personal ID 001, 007, and 010 is the same 3rd floor as the destination floor before the change for personal ID 003, and because the assigned elevator is Elevator A. In contrast to this, for example, it is assumed that a user having personal ID 009 changed his or her destination floor from the 9th floor to another floor. In this case, in the registered destination floor storage section 6*c*, both the registration of the destination floor after the change and the deletion of the destination floor before the change are performed. This is because there is no data on other personal ID for the 9th floor which is the same as the destination floor before the change for personal ID 009.

In the case where in Step S2 it is ascertained that the destination floor and the assigned elevator have not been stored for the same personal ID as the personal ID from the personal authentication device, the flow of actions proceeds to Step S10. In Step S10, a destination floor call is newly registered by the personal authentication device of the destination floor changing device 4 on the basis of the personal ID obtained from the ID card of the user and the information on the destination floor.

After Step 9 and Step 10 and in the case where in Step S3 it is ascertained the destination floor has not been inputted to the destination floor input device 4*b*, the flow of actions proceeds to Step S11. In Step S11, the hall call registration apparatus main body 6 transmits the assigned car information from the destination floor changing section 6*h* to the changed, assigned elevator indicator 5. And the changed, assigned elevator indicator 5 indicates the assigned car on the basis of this assigned car information.

After Step 11 and in the case where in Step S1 it is ascertained verification in the personal authentication device has not been performed, the flow of actions proceeds to Step S12. In Step S12, on the basis of the output from the car arrival detection section 6*e*, the hall call registration apparatus main body 6 ascertains whether or not the car of the assigned elevator has arrived at the call-occurring floor. In the case where in Step S12 it is ascertained that the assigned car has not arrived at the call-occurring floor, the flow of actions returns to Step S1. On the other hand, in the case where it is ascertained that the assigned car has arrived at the call-occurring floor, the flow of actions proceeds to Step S13.

In Step S13 the car call registration/deletion section 6*f* of the hall call registration apparatus main body 6 refers to the destination floor for the assigned car stored in the registered destination floor storage section 6*c*, and registers the destination floor call to this destination floor for the relevant assigned car. And in S14 following this step, on the basis of the output from the car departure detection section 6*g*, the hall call registration apparatus main body 6 ascertains whether or not the assigned car has departed from the call-occurring floor. In the case where in Step S14 it is ascertained that the assigned car has not departed from the call-occurring floor, the flow of actions returns to Step S1. On the other hand, in the case where it is ascertained that the assigned car has departed from the call-occurring floor, the flow of actions returns to Step S15.

In Step S15, the destination floor registrar storage section 6*b* of the hall call registration apparatus main body 6 deletes the data on the personal ID to which the car of the elevator which departed from the call-occurring floor is assigned. In Step S16 following this step, the registered destination floor storage section 6*c* of the hall call registration apparatus main body 6 deletes the data on the destination floor for the car of the elevator which departed from the call-occurring floor. When the processing of Step S16 is finished, the series of flow of actions are finished.

Incidentally, in this embodiment, it is assumed that the security gate 1 is installed in a place leading to the hall of the elevator. Needless to say, the installation place of this security gate 1 may be an entrance to the building where the elevator is installed. In this case, the call-occurring floor becomes the entrance floor. Also, a device which registers a hall call by personal authentication may be installed in a hall and the like in place of the security gate 1 which permits passage by personal authentication. In this device, a hall call is registered in the case where personal authentication is successful. In this case, it is necessary only that this relevant device be provided with the destination floor registration apparatus 2 and the registered, assigned elevator indicator 3.

The hall call registration apparatus of an elevator configured as described above authenticates an elevator user in the personal authentication device of the destination floor registration apparatus 2. And on the basis of the verification information including the personal ID unique to the user verified in the personal authentication device of this destination floor registration apparatus 2, the hall call registration apparatus main body 6 performs the registration of a destination floor call of an elevator. Also, there is provided the destination floor changing device 4 which accepts an operation by which a user changes the destination floor of destination floor call registration. And on the basis of the contents of the operation performed in the destination floor changing device 4, the hall call registration apparatus main body 6 changes the destination floor of destination floor call registration in the case where it is judged that the above-described operation is by the user who was authenticated in the personal authentication device of the destination floor registration apparatus 2.

The judgment as to whether or not the operation performed in the destination floor changing device 4 was performed by the user who was authenticated in the personal authentication device of the destination floor registration apparatus 2 (the security gate 1), is made by ascertaining whether or not the personal ID verified in the personal authentication device 4*a* provided in the destination floor changing device 4 is the same as the personal ID verified in the personal authentication device of the destination floor registration apparatus 2.

More specifically, first, in the destination floor registrar storage section 6*b*, the destination floor of destination floor call registration and the elevator assigned to the relevant destination floor call registration are correlated to the personal ID verified in the personal authentication device of the destination floor registration apparatus 2 and stored. And in the case where the destination floor and the elevator are correlated to the same personal ID as the personal ID verified in the personal authentication device 4*a* of the destination floor changing device 4 and stored in this destination floor registrar storage section, it is ascertained that the personal ID verified in the personal authentication device 4*a* provided in the destination floor changing device 4 and the personal ID verified in the personal authentication device of the destination floor registration apparatus 2 are the same.

And in the hall call registration apparatus of an elevator configured in this manner, in a hall call registration apparatus which automatically registers a destination floor call on the basis of the verification information by a personal authentication device at a security gate and the like, in the case where a user desires to go to a destination floor different from a destination floor of call registration which is automatically performed, it is possible to eliminate useless destination floor call registration and to prevent the worsening of the operational efficiency beforehand.

Embodiment 2

Figure 5:
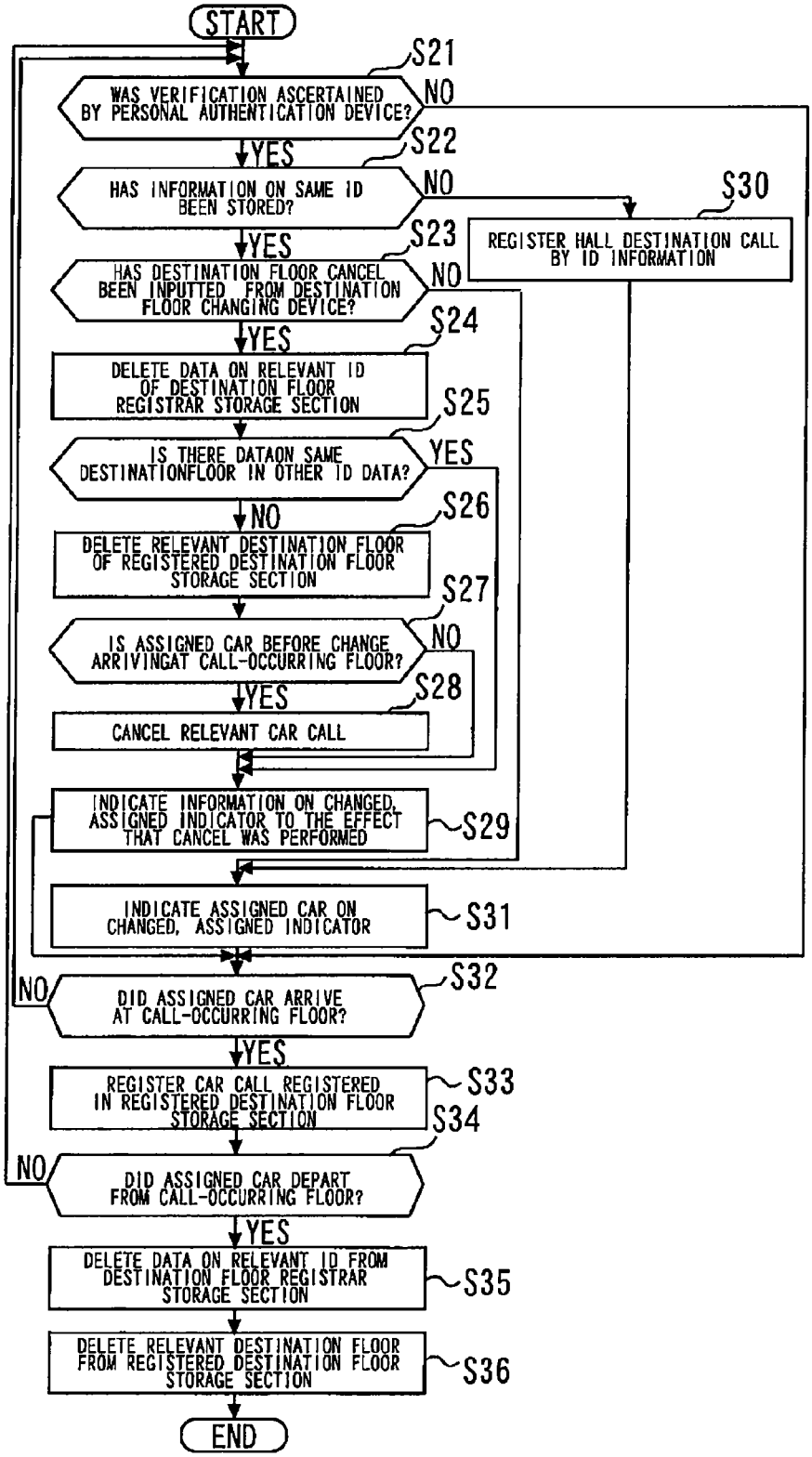
FIG. 5 is a flowchart showing the flow of operations of the hall call registration apparatus of an elevator related to Embodiment 2 of the present invention.

FIG. 5 relates to Embodiment 2 of the present invention and is a flowchart showing the actions of the hall call registration apparatus of an elevator.

Embodiment 1 described above ensures that a destination floor of call registration which is automatically registered on the basis of verification information in a personal authentication device, such as a security gate, can be changed by operations in the destination floor changing device. In contrast to this, Embodiment 2 which will be described here ensures that a destination floor of call registration which is automatically registered on the basis of verification information in a personal authentication device, such as a security gate, can be canceled by operations in the destination floor changing device.

That is, in the destination floor input device 4*b* of the destination floor changing device 4, a user can perform a cancel operation of call registration. In this case, a button other than each numerical button of 0 to 9, for example, the "-" button is used as a cancel button. And a cancel operation of call registration is performed when a user pushes this cancel button. First, a user who desires to cancel a call registration performs a personal authentication operation in the personal authentication device 4*a*. And next, the user performs a cancel operation in place of inputting a destination floor in the destination floor input device 4*b*.

Incidentally, other configurations are the same as in Embodiment 1 and detailed descriptions thereof are omitted.

In this embodiment, the hall call registration apparatus of an elevator acts in accordance with a series of flow of actions shown in FIG. 5.

First, Steps S21 and S22 are the same as Step S1 and S2 of FIG. 4 of Embodiment 1, respectively. Therefore, detailed descriptions of these steps are omitted. And in Step S23, the hall call registration apparatus main body 6 ascertains whether or not a cancel of a destination floor was inputted by a user via the destination floor input device 4*b* of the destination floor changing device 4. In the case where in Step S23 it is ascertained that a cancel has been inputted to the destination floor input device 4*b*, the flow of actions proceeds to Step S24. On the other hand, in the case where it is ascertained that a cancel has not been inputted, the flow of actions proceeds to Step S31.

In Step S24 the hall call registration apparatus main body 6 updates the contents of the information table stored in the destination floor registrar storage section 6*b*. That is, concerning the information table stored in the destination floor registrar storage section 6*b*, the hall call registration apparatus main body 6 deletes the data on the destination floor and the assigned elevator for the personal ID ascertained in Step S22. And the flow of actions proceeds to Step S25. Steps S25 to S28 are the same as Steps S4 to S8 of FIG. 4 of Embodiment 1, respectively. Therefore, detailed descriptions of these steps are omitted.

In Step S29, the hall call registration apparatus main body 6 causes information to be transmitted from the destination floor changing section 6*h* to the changed, assigned elevator indicator 5 to the effect that the destination floor call registration has been canceled. And the changed, assigned elevator indicator 5 indicates that the destination floor call registration has been canceled. Step S29 is followed by Step S32. Incidentally, Steps S30 to S36 are the same as Steps S10 to S16 of FIG. 4 of Embodiment 1, respectively. Therefore, detailed descriptions of these steps are omitted.

Incidentally, both the configurations and actions of Embodiment 2 described here and the configurations and actions of Embodiment 1 may be provided. In this case, the destination floor changing device 4 accepts operations by which a user performs at least one of a change and a cancel of the destination floor of destination floor call registration.

Also in the hall call registration apparatus of an elevator configured as described above, it is possible to produce the same effects as in Embodiment 1 by canceling a useless call registration.

Embodiment 3

Figure 6:
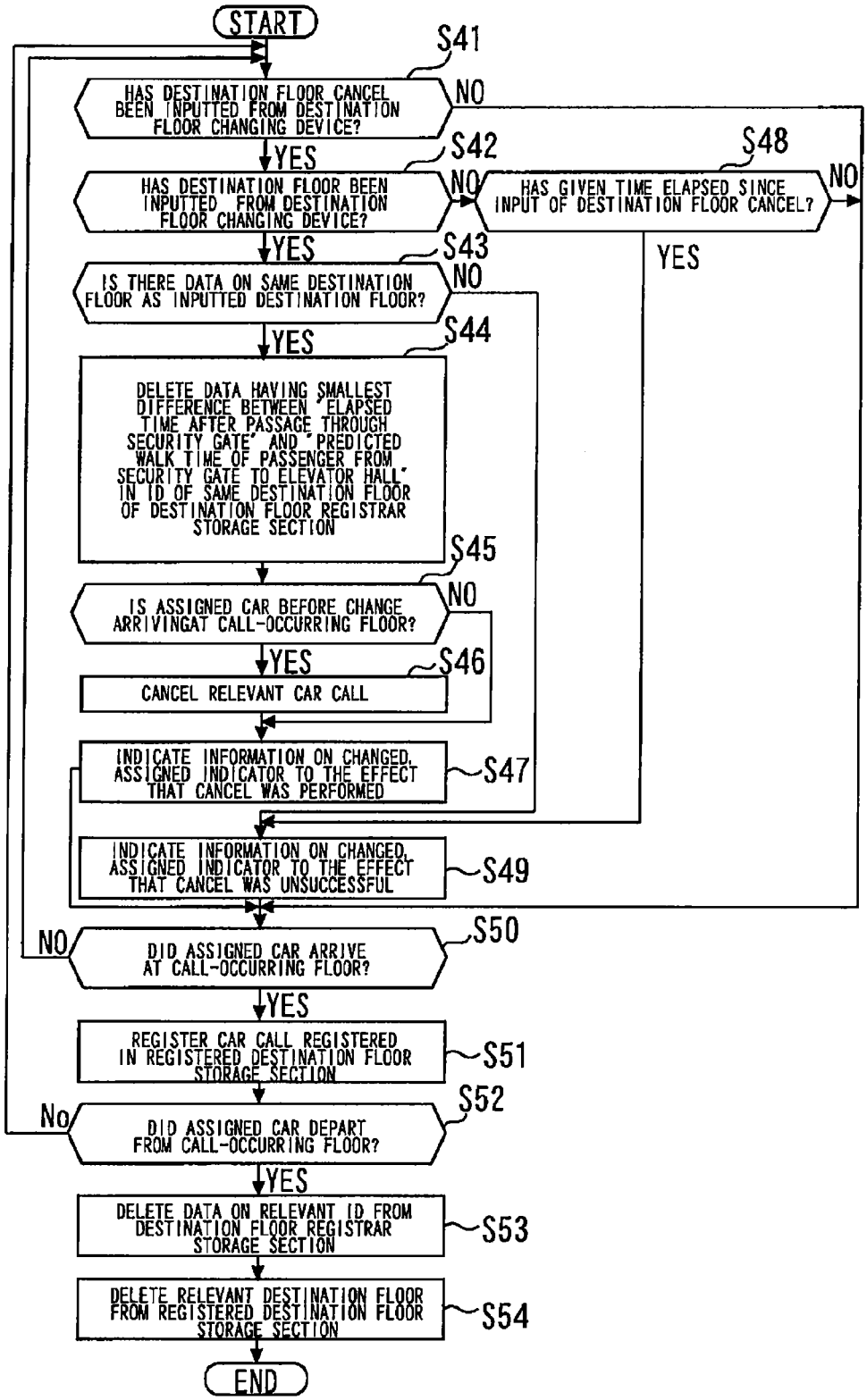
FIG. 6 is a flowchart showing the flow of operations of the hall call registration apparatus of an elevator related to Embodiment 3 of the present invention.

FIG. 6 relates to Embodiment 3 of the present invention and is a flowchart showing the actions of the hall call registration apparatus of an elevator.

Embodiment 2 described above ensures that a destination floor of call registration which is automatically registered on the basis of verification information in a personal authentication device, such as a security gate, can be canceled by operations which go through personal authentication in the destination floor changing device. In contrast to this, Embodiment 3 which will be described here ensures that a destination floor of call registration which is automatically registered on the basis of verification information in a personal authentication device, such as a security gate, can be canceled by operations in the destination floor changing device without going through personal authentication.

That is, first, a user who desires to cancel a call registration pushes the "-" button, which is a cancel button in the destination floor input device 4*h*. Next, the user inputs a destination floor of call registration which the user desires to cancel by pushing a numerical button in the destination floor input device 4*b*. A cancel operation of call registration is performed in this manner.

When a cancel operation is performed in the destination floor input device 4*b* of the destination floor changing device 4, the destination floor registrar storage section 6*b* of the hall call registration apparatus main body 6 ascertains the contents of the stored information table. Specifically, the destination floor registrar storage section 6*b* ascertains whether or not there is personal ID data in which the same destination floor as the destination floor to be canceled, which is inputted by a cancel operation, is registered.

And in the case where there are a plurality of personal ID for which the same destination floor as the destination floor to be canceled is registered, for each of the personal ID, a difference between "the elapsed time after the passage through the security gate 1" and "the predicted walk time spent by a user to walk from the security gate 1 to the hall (elevator hall)" is found. Incidentally, "the predicted walk time spent by a user to walk from the security gate 1 to the hall" may be found beforehand for each personal ID or an average value for all personal ID may be used.

The hall call registration apparatus main body 6 judges that the user having personal ID in which the difference between "the elapsed time after the passage through the security gate 1" and "the predicted walk time spent by a user to walk from the security gate 1 to the hall" is the smallest, is the user who performed the relevant cancel operation. And the hall call registration apparatus main body 6 deletes the data on the personal ID in which the difference between "the elapsed time after the passage through the security gate 1" and "the predicted walk time spent by a user to walk from the security gate 1 to the hall" is the smallest, from the information table of the destination floor registrar storage section 6*b*.

Incidentally, other configurations are the same as in Embodiment 2 and detailed descriptions thereof are omitted.

In this embodiment, the hall call registration apparatus of an elevator acts in accordance with a series of flow of actions shown in FIG. 6.

First, in Step S41 the hall call registration apparatus main body 6 ascertains whether or not a cancel of a destination floor has been inputted by a user via the destination floor input device 4*b* of the destination floor changing device 4. In the case where in Step S41 it is ascertained that a cancel of a destination floor has been inputted to the destination floor input device 4*b*, the flow of actions proceeds to Step S42. On the other hand, in the case where it is ascertained that a cancel of a destination floor has not been inputted, the flow of actions proceeds to Step S50.

In Step S42 the hall call registration apparatus main body 6 ascertains whether or not a destination floor to be canceled has been inputted by a user via the destination floor input device 4*b* of the destination floor changing device 4. In the case where in Step S42 it is ascertained that the destination floor has been inputted to the destination floor input device 4*b*, the flow of actions proceeds to Step S43. On the other hand, in the case where it is ascertained that the destination floor has not been inputted, the flow of actions proceeds to Step S48.

In Step S43 the hall call registration apparatus main body 6 ascertains whether or not there is data on personal ID in which the same destination floor as the destination floor to be canceled inputted in Step S42 described above is registered. In the case where in Step S43 it is ascertained that in the information table of the destination floor registrar storage section 6*b*, there is data on personal ID in which the same destination floor as the inputted destination floor is registered, the flow of actions proceeds to Step S44. On the other hand, in the case where it is ascertained that there is no data on personal ID in which the same destination floor as the inputted destination floor is registered, the flow of actions proceeds to Step S49.

In Step S44, for each personal ID in which the same destination floor as the destination floor to be inputted in Step S43 described above is registered, the hall call registration apparatus main body 6 finds a difference between "the elapsed time after the passage through the security gate 1" and "the predicted walk time spent by a user to walk from the security gate 1 to the hall (elevator hall)." And the hall call registration apparatus main body 6 judges that the user with personal ID having the smallest difference is the user who performed the relevant cancel operation. Thereafter, the hall call registration apparatus main body 6 deletes the personal ID data having the smallest difference from the information table of the destination floor registrar storage section 6*b*. Step S44 is followed by Step S45. Steps S45 to S47 are almost the same as Steps S27 to S29 of FIG. 5 of Embodiment 2. Therefore, detailed descriptions of these steps are omitted.

And in the case where in S42 it is ascertained that the destination floor to be canceled has not been inputted to the destination floor input device 4*b*, the flow of actions proceeds to Step S48. In Step S48 the hall call registration apparatus main body 6 ascertains whether or not a given time determined beforehand has elapsed since the cancel of the destination floor is inputted to the destination floor input device 4*b* in Step S41 described above. In the case where in Step S48 it is ascertained that a given time has elapsed since the cancel of the destination floor is inputted in Step S48, the flow of actions proceeds to Step S49. On the other hand, in the case where it is ascertained that a given time has not elapsed since the cancel of the destination floor is inputted, the flow of actions proceeds to Step S50.

And in the case where in S43 it is ascertained that there is no data on personal ID in which the same destination floor as the destination floor to be inputted is registered and in the case where it is ascertained in Step S48 that a given time has elapsed since the cancel of the destination floor is inputted, the flow of actions proceeds to Step S49. In Step S49 the hall call registration apparatus main body 6 transmits information from the destination floor changing section 6*h* to the changed, assigned elevator indicator 5 to the effect that the cancel of the destination floor call registration was unsuccessful. And the changed, assigned elevator indicator 5 indicates that the cancel of the destination floor call registration was unsuccessful. Step S49 is followed by Step S50. Incidentally, Steps S50 to S54 are the same as Steps S32 to S36 of FIG. 5 of Embodiment 2, respectively. Therefore, detailed descriptions of these steps are omitted.

Incidentally, in this embodiment, the description was given of the case where it is ensured that the destination floor of call registration which is automatically registered on the basis of the verification information in a personal authentication device, such as a security gate, can be canceled without going through personal authentication. In the same manner as this, it is also possible to ensure that the destination floor of call registration which is automatically registered on the basis of the verification information in a personal authentication device can be changed without going through personal authentication.

In the hall call registration apparatus of an elevator configured as described above, it is possible to produce the same effects as in Embodiment 1 and Embodiment 2. In addition, it is possible to perform a change and a cancel of a destination floor of call registration by simple operations without going through personal authentication, thereby providing convenience to users.

INDUSTRIAL AVAILABILITY

The present invention can be used in a hall call registration apparatus of an elevator which performs destination floor call registration of an elevator on the basis of verification information including personal ID unique to the user who has been verified in a personal authentication device.

DESCRIPTION OF SYMBOLS

1 security gate
2 destination floor registration apparatus
3 registered, assigned elevator indicator
4 destination floor changing device
4*a* personal authentication device
4*b* destination floor input device
5 changed, assigned elevator indicator
6 hall call registration apparatus main body
6*a* destination floor registration section
6*b* destination floor registrar storage section
6*c* registered destination floor storage section
6*d* car arrangement section
6*e* car arrival detection section
6*f* car call registration/deletion section
6*g* car departure detection section
6*h* destination floor changing section
7 each-elevator controller

The invention claimed is:

1. A hall call registration apparatus of an elevator, comprising:

a first personal authentication device which authenticates a user of an elevator;

a hall call registration apparatus main body which performs destination floor call registration of an elevator on the basis of verification information including personal ID unique to the user who was verified by the first personal authentication device;

a destination floor changing device which accepts an operation for the user to perform at least one of a change and a cancel of the destination floor call registration; and a second personal authentication device which is provided in the destination floor changing device and authenticates the user, wherein in a case that a personal ID verified by the second personal authentication device is the same as a personal ID verified by the first personal authentication device, the hall call registration apparatus main body judges that the operation is performed by the user who is authenticated in the first personal authentication device and performs a change and/or a cancel of a destination floor of the destination floor call registration.

2. The hall call registration apparatus of an elevator according to claim 1, wherein the hall call registration apparatus main body comprises:

a destination floor registrar storage section which stores the destination floor of the destination floor call registration and an elevator assigned to the destination floor call registration in association with the personal ID verified by the first personal authentication device; and a destination floor changing section which performs a change and/or a cancel of the destination floor of the destination floor call registration in a case that the destination floor and the elevator are stored in the destination floor registrar storage section in association with the same personal ID as the personal ID verified by the second personal authentication device.

3. The hall call registration apparatus of an elevator according to claim 1, wherein the first personal authentication device is provided in a place leading to a hall of an elevator, the destination floor changing device is provided in the hall, and the hall call registration apparatus main body judges whether or not the operation is performed by the user who is authenticated by the first personal authentication device on the basis of a difference between an elapsed time from the authentication by the first personal authentication device to an operation in the destination floor changing device and a predicted moving time required by a user to move from the first personal authentication device to the hall.

* * * * *